US007144139B2

(12) United States Patent
Kramer et al.

(10) Patent No.: US 7,144,139 B2
(45) Date of Patent: Dec. 5, 2006

(54) FLEXIBLE SURFACE LIGHTING SYSTEM

(76) Inventors: Eric W. Kramer, 3108 Tyrol Dr., Laguna Beach, CA (US) 92651; Thomas T. Nagano, 11342 Bos St., Cerritos, CA (US) 90701; Kiem Lee, 8016 Bright Ave., Whittier, CA (US) 90602

( * ) Notice: Subject to any disclaimer, the term of this patent is extended or adjusted under 35 U.S.C. 154(b) by 150 days.

(21) Appl. No.: 10/798,043

(22) Filed: Mar. 10, 2004

(65) Prior Publication Data

US 2005/0201091 A1 Sep. 15, 2005

(51) Int. Cl.
*F21V 11/00* (2006.01)
*F21V 21/02* (2006.01)

(52) U.S. Cl. ..... 362/368; 362/249; 362/240; 362/800

(58) Field of Classification Search ..... 362/146, 362/153, 236, 238, 249, 368, 240
See application file for complete search history.

(56) References Cited

U.S. PATENT DOCUMENTS

| | | | | | |
|---|---|---|---|---|---|
| 4,625,266 | A * | 11/1986 | Winter | 362/146 |
| 5,430,627 | A * | 7/1995 | Nagano | 362/146 |
| 5,499,170 | A * | 3/1996 | Gagne | 362/153 |
| 5,954,425 | A | 9/1999 | Lin | |
| 5,980,273 | A | 11/1999 | Yong et al. | |
| 6,017,241 | A | 1/2000 | Komai | |
| 6,074,074 | A * | 6/2000 | Marcus | 362/240 |
| 6,076,936 | A * | 6/2000 | George | 362/146 |
| 6,116,748 | A | 9/2000 | George | |
| 6,145,996 | A | 11/2000 | Shimada | |
| 6,283,612 | B1 | 9/2001 | Hunter | |
| 6,364,507 | B1 | 4/2002 | Yang | |
| 6,386,733 | B1 * | 5/2002 | Ohkohdo et al. | 362/249 |
| 6,406,173 | B1 * | 6/2002 | Serizawa et al. | 362/238 |
| 6,523,986 | B1 * | 2/2003 | Hoffmann | 362/153 |
| 6,554,446 | B1 | 4/2003 | Walsh et al. | |
| 6,561,689 | B1 | 5/2003 | Kidd et al. | |
| 6,566,824 | B1 | 5/2003 | Panagotacos et al. | |
| 6,582,100 | B1 | 6/2003 | Hochstein et al. | |
| 6,595,671 | B1 | 7/2003 | Lefebvre et al. | |
| 6,660,935 | B1 * | 12/2003 | Southard et al. | 362/249 |
| 2001/0007526 | A1 | 7/2001 | Ohkohdo et al. | |
| 2001/0036082 | A1 | 11/2001 | Kanesaka | |
| 2002/0110000 | A1 * | 8/2002 | Marcus | 362/555 |
| 2003/0063463 | A1 | 4/2003 | Sloan et al. | |

OTHER PUBLICATIONS

McMaster-Carr Durometer Hardness Scales, p. 3272.

* cited by examiner

*Primary Examiner*—Thomas M. Sember
*Assistant Examiner*—Ismael Negron
(74) *Attorney, Agent, or Firm*—Gordon E. Gray, III

(57) ABSTRACT

A system with a pair of flange extrusions and a base extrusion having a channel for electrical leads and lighting. A preferred embodiment has a base extrusion of polyvinyl chloride (PVC) of 89–98 Duro on the Shore OO scale. The base extrusion is connected, on opposite sides of the channel, to a first flange extrusion and a second flange extrusion of PVC with a hardness of preferably of 90 Duro. Electrical leads are placed in the channel. A lens is inserted into the channel over the leads. A replaceable LED module having a circuit board secured to a module base is attached to the leads. The circuit board preferably has a gasket or seal, an LED and two contact teeth that make electrical contact with the leads.

15 Claims, 6 Drawing Sheets

FLEXIBLE SURFACE LIGHTING SYSTEM

TECHNICAL FIELD

The present invention is a flexible surface lighting system with replaceable LED module. In particular, the present invention is directed to a flexible surface lighting system with a set of soft flanges and a more rigid base with a channel for electrical leads and lighting.

BACKGROUND ART

Generally, theater and auditorium venue lighting systems use lighting mounted on floors, seating and/or walls to guide patrons and provide a pleasing aesthetic while reducing the effect of said lighting on any events at the venue. However, these venue lighting systems are often exposed to difficult environmental factors such as beverage spills and cleaning agents. A number of lighting systems are known including U.S. Pat. Nos. 6,554,446, 6,283,612, 6,145,996, 6,116,748, 6,582,100, 6,386,733, and 5,954,425. However, these lighting systems generally do not provide for, inter alia, adequate resistance to the environmental factors, simplified replacement of individual lights or sets of lights, or flexible options for mounting the lighting systems on various venue surfaces.

The present invention provides a flexible surface lighting system for use on various venue surfaces, is more resistant to venue environmental factors, and provides for an easier method of installing/replacing one or more lights.

SUMMARY OF THE INVENTION

The present invention is a flexible surface lighting system with replaceable LED module. In particular, the present invention is directed to a system with a set of soft flanges and a more rigid base with a channel for electrical leads and lighting. A preferred embodiment has a base extrusion of polyvinyl chloride (PVC) of 89–98 Duro on the Shore OO scale with a channel. The base is connected, on opposite sides of the channel, to a first flange extrusion and a second flange extrusion of PVC with a hardness of preferably of 90 Duro. Electrical leads are placed in the channel. A lens is inserted into the channel over the leads. A replaceable LED module having a circuit board secured to a module base is attached to the leads. The circuit board preferably has a gasket, an LED and two contact teeth that make electrical contact with the leads.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide flexible surface lighting system with replaceable LED modules.

Figure 1:
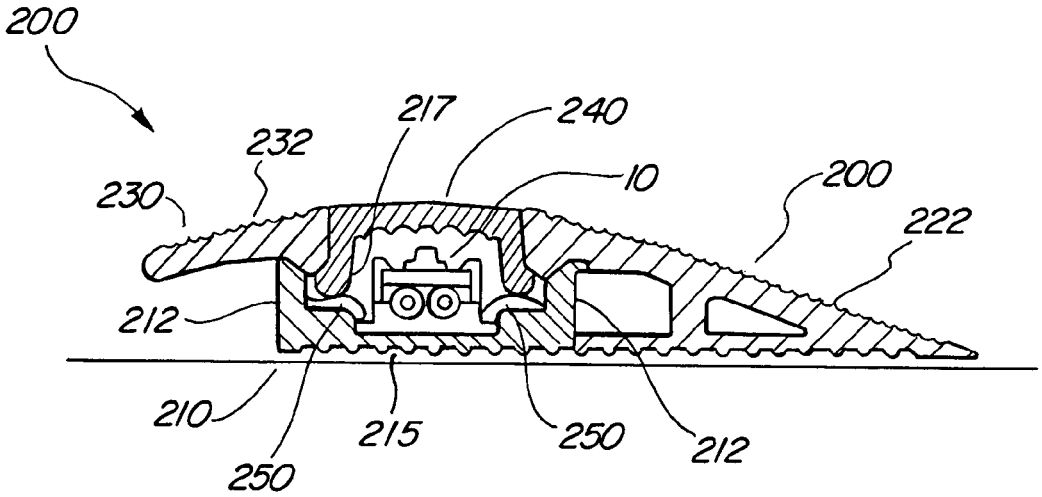
FIG. 1 is a side view of a preferred embodiment of the invention with a "carpet to edge" flange configuration and a replaceable LED module installed.

Referring now to FIG. 1, a side view of a preferred embodiment of the invention 200 is shown in a "carpet to edge" flange configuration. A base 210 is preferably co-extruded with a first flange 220 and a second flange 230. The preferred material for extruding is polyvinyl chloride (PVC). The base 210 preferably has a mount surface 215 and two sides 212 which create a channel 217. The channel 217 is typically used to house electrical leads 100, 105 and lighting elements such as the replaceable LED module 10 shown and as described below.

The first flange 220 shown in FIG. 1 is an edge flange, preferably for use when the flange 220 does not abut another surface such as a wall or carpeting. For example, the first flange can be used on the edge of a stair or tapering into an aisle. The second flange 230 is a carpet or wall flange, preferably for use when the second flange 230 abuts a carpeted surface or a wall. The flanges 220 and 230 shown in FIG. 1 are positioned on the sides 212 of the channel 217. A lens 240 is inserted between the flanges 220, 230 and into the channel 217 and is held in the channel 217 by the flanges 220, 230. The lens 240 is used to, inter alia, shield the leads 100, 105 and light sources housed in the channel 217. Preferably, the lens 240 contacts lens buffers 250 on the base 210.

The preferred embodiment shown in FIG. 1 has ridges on the mount surface 215 and bottom of the first flange 220. These ridges are useful when the invention 200 is mounted to a surface with glue. Additionally, the first flange 220 and second flange 230 are shown with a surface tread 222, 232 to provide additional traction to patrons that step on the invention 200.

The base 210 is preferably co-extruded with the first flange 220, second flange 230 and impact buffers 250. The preferred embodiment of the base 210 has a hardness of 89–98 Duro on the Shore OO hardness scale, preferably 94

Duro. PVC of 94 Duro is generally considered "rigid" PVC. The preferred embodiment of the first flange 220, second flange 230 and impact buffer 250 extrusions have a hardness less than the base extrusion ranging from 85–95 Duro on the Shore OO hardness scale, preferably 90 Duro. PVC of 90 Duro is generally considered "flexible" PVC. By having extrusions of differing hardness, the invention 200 provides various advantages. For example, the flexible PVC flanges absorb more impact from patrons stepping on the invention 200. This provides for a more comfortable venue surface. The more rigid base 210 provides a more solid channel to hold light sources, such as the LED module 10, and electrical leads 100, 105 in place. The more rigid base 210 allows for cuts of specific lengths and easier installation on irregular surfaces.

Figure 2:
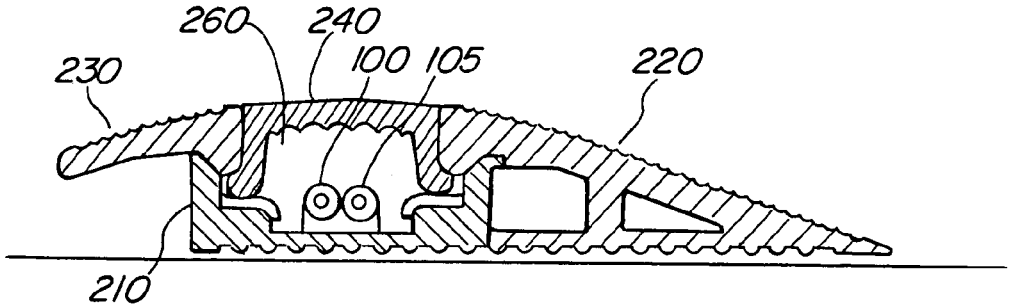
FIG. 2 is a side view of a preferred embodiment of the invention with a "carpet to edge" flange configuration and a butt seal installed.

Additionally, the flexible PVC flanges 220, 230 and lens buffers 250 act as gaskets to seal against the sides 212 of the channel 217 and the lens 240. This provides additional protection for the light sources and electrical leads. Referring to FIG. 2, a butt seal 260 can be inserted below the lens 240 in the channel 217 to provide additional protection for the electrical components 10, 100 and 105. In particular, if the PVC material of the invention expands or contracts due to changes in room temperature, the butt seal can provide additional protection. The butt seal 260 is preferably made of neoprene of 20 Duro on the Shore OO hardness scale. Lengths of butt seal 260 are inserted into the channel 217 between light sources 10 on the electrical leads 100, 105.

Figure 3:
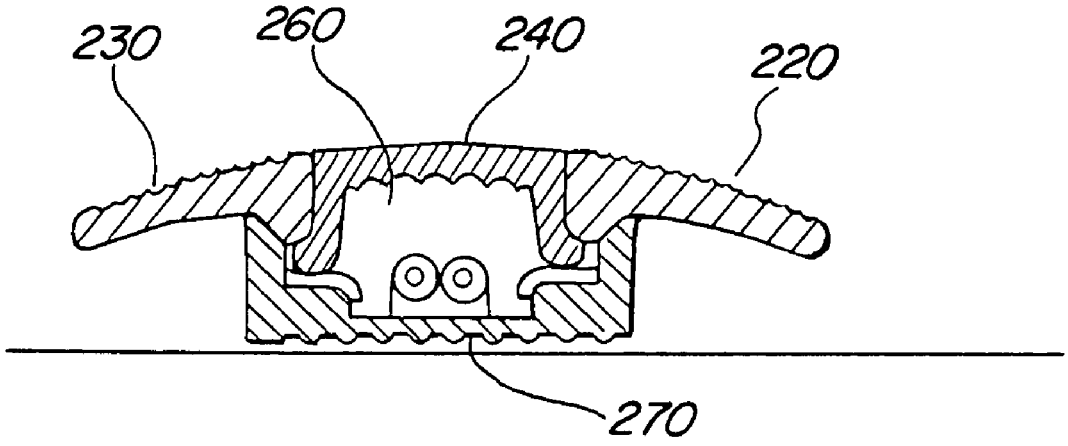
FIG. 3 is a side view of a preferred embodiment of the invention with a "carpet to carpet/carpet to wall" flange configuration and a replaceable LED module installed.
Figure 4:
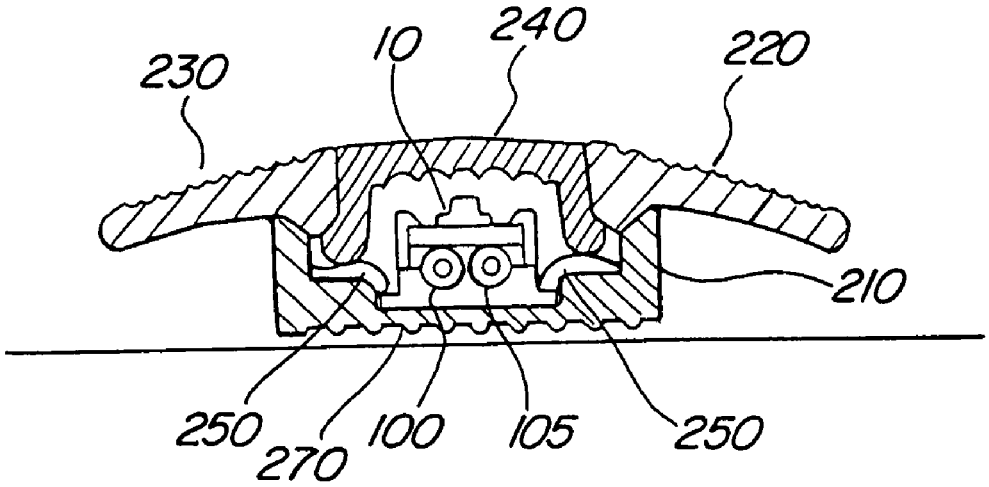
FIG. 4 is a side view of a preferred embodiment of the invention with a "carpet to carpet/carpet to wall" flange configuration and a butt seal installed.

Referring now to FIGS. 3 and 4, preferred embodiments of the invention 200 are shown in "carpet to wall/carpet" configuration. The first flange 220 and second flange 230 both are preferably for use when the flanges 220, 230 abut a carpeted surface or a wall. FIG. 3 shows the invention 200 with a butt seal 260 and FIG. 4 shows the invention with the LED module 10 installed on electrical leads 100, 105. Moreover, FIGS. 1, 2, 3 and 4 each show a groove 270 below the electrical leads 100, 105. This groove is used to act as a pilot or guide for drilling through the mount surface 215 when, instead or in addition to glue, a screw mount is required to mount the invention to a surface.

Figure 6:
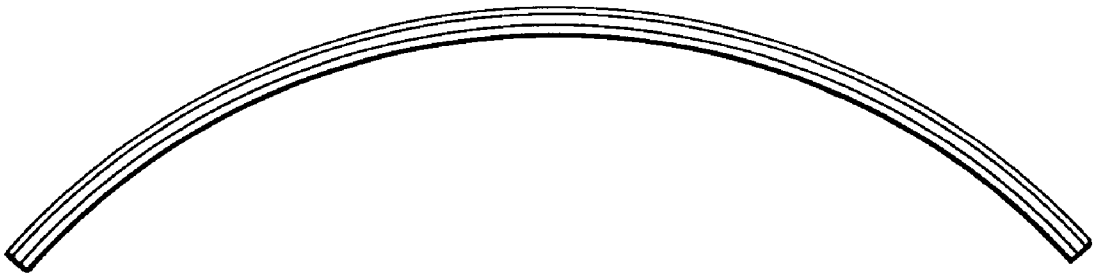
FIG. 6 is a top view of a preferred embodiment of the invention with a "carpet to carpet/carpet to wall" flange configuration displayed in a curved position.
Figure 7:
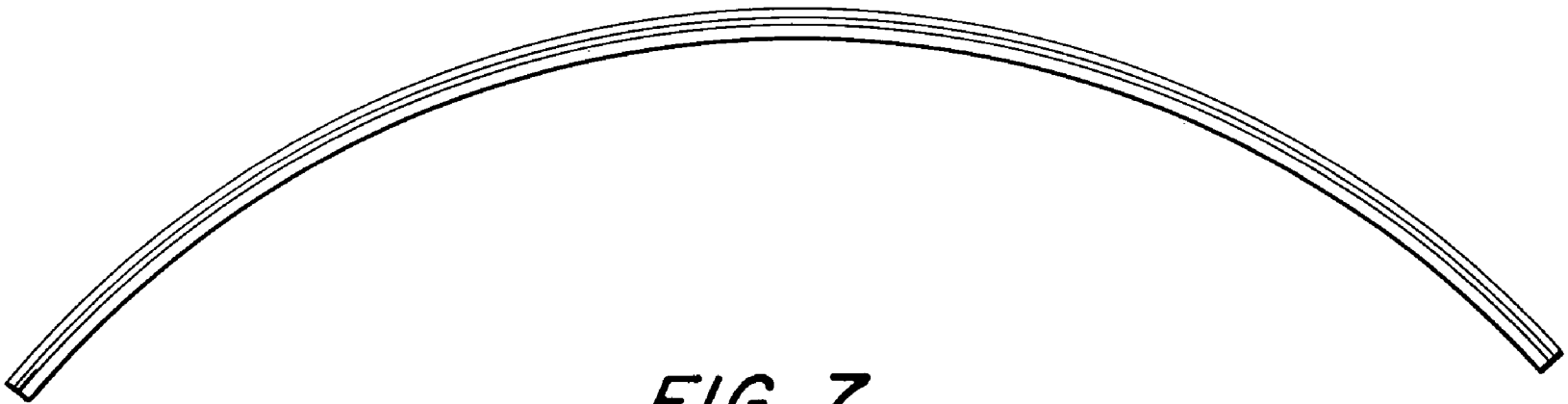
FIG. 7 is a to view of a preferred embodiment of the invention with a "carpet to edge" flange configuration displayed in a curved position.

The combination of the flexible PVC 220, 230 and 250 and the rigid PVC 210 allow for an overall flexible lighting system for mounting on surfaces in a variety of curves while maintaining a channel for the light sources and electrical leads. Segments of the invention 200 in a "carpet to carpet" configuration, as shown in FIG. 6, can be curved to follow a circle of a four-foot (4 ft) radius. Segments of the invention 200 in a "carpet to edge" configuration, as shown in FIG. 7, can be curved to follow a circle of a seven-foot (7 ft) radius. This flexibility also allows for mounting in more irregular shapes and on more irregular surfaces.

Figure 5:
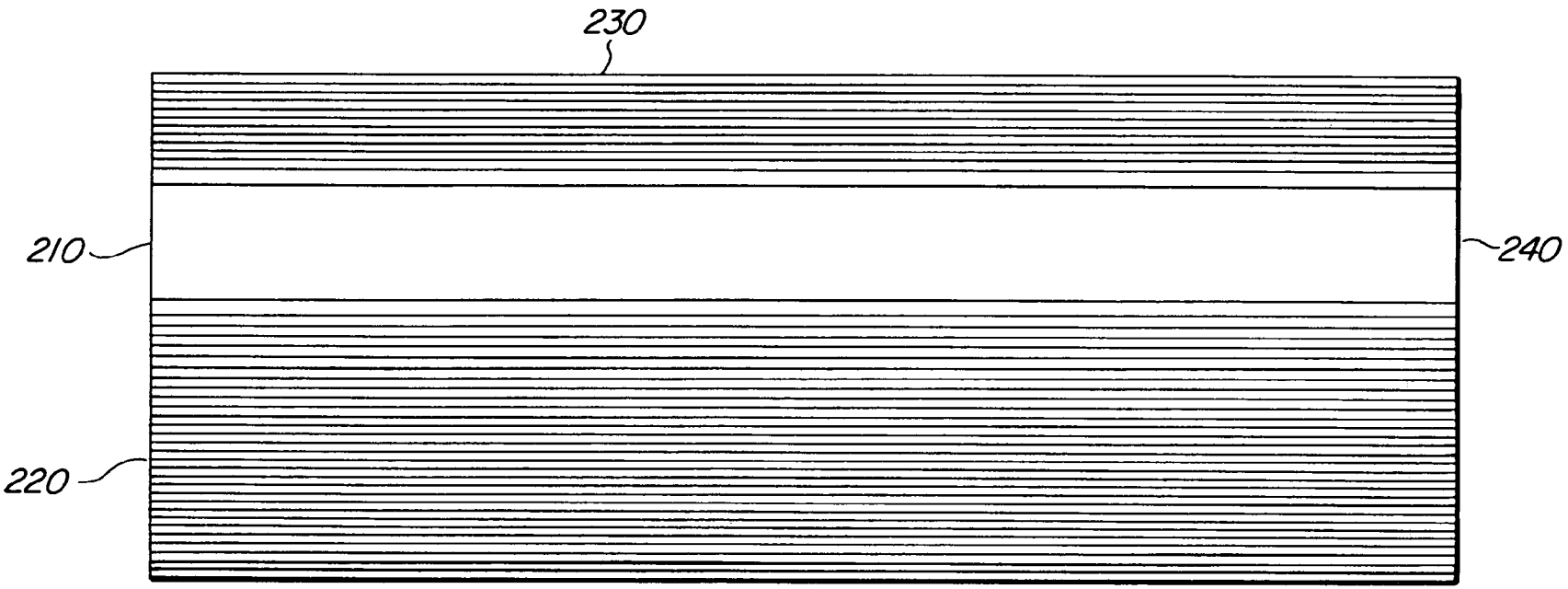
FIG. 5 is a top view of a preferred embodiment of the invention with a "carpet to edge" flange configuration.

Referring now to FIG. 5, a top view of another preferred embodiment of the invention 200 is shown. However, the base 210 is preferably made from a lighter color PVC than the flanges 220, 230. A base 210 having a reflectance factor greater than the flanges 220 and 230, e.g., colored white or light gray, can provide additional visibility of surfaces to patrons, e.g. defining an aisle, when reflecting light from an external source. An example of these advantages is discussed in U.S. Pat. No. 6,554,446, said patent is incorporated herein by reference.

Thus, a flexible surface lighting system with replaceable LED modules is described above that is for use on various venue surfaces, is more resistant to venue environmental factors, and provides for an easier method of installing/replacing one or more lights as discussed below. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. For example, other plastics can be used for extrusion. Alternately, various elements of the invention can be separately extruded and later connected. Therefore, it is to be understood that, within the scope of the appended claims, the invention may be practiced other than as specifically described herein.

Improved Replaceable LED Module for Use in Flexible Surface Lighting System

The flexible surface lighting system described above is suited for use with a novel replaceable LED module described below. By using this module, the system has improved resistance to the deleterious effects of immersion in fluids found in typical theater environments. Referring to FIG. 1, a preferred embodiment of a replaceable LED module 10 is shown installed in a preferred embodiment of the flexible surface lighting system 200 in a carpet to edge configuration. Butt seals 260, as described above, can be placed between LED modules 10 on the electrical leads 100, 105 to provide added protection to the system as whole as shown in FIGS. 2 and 3.

Figure 8:
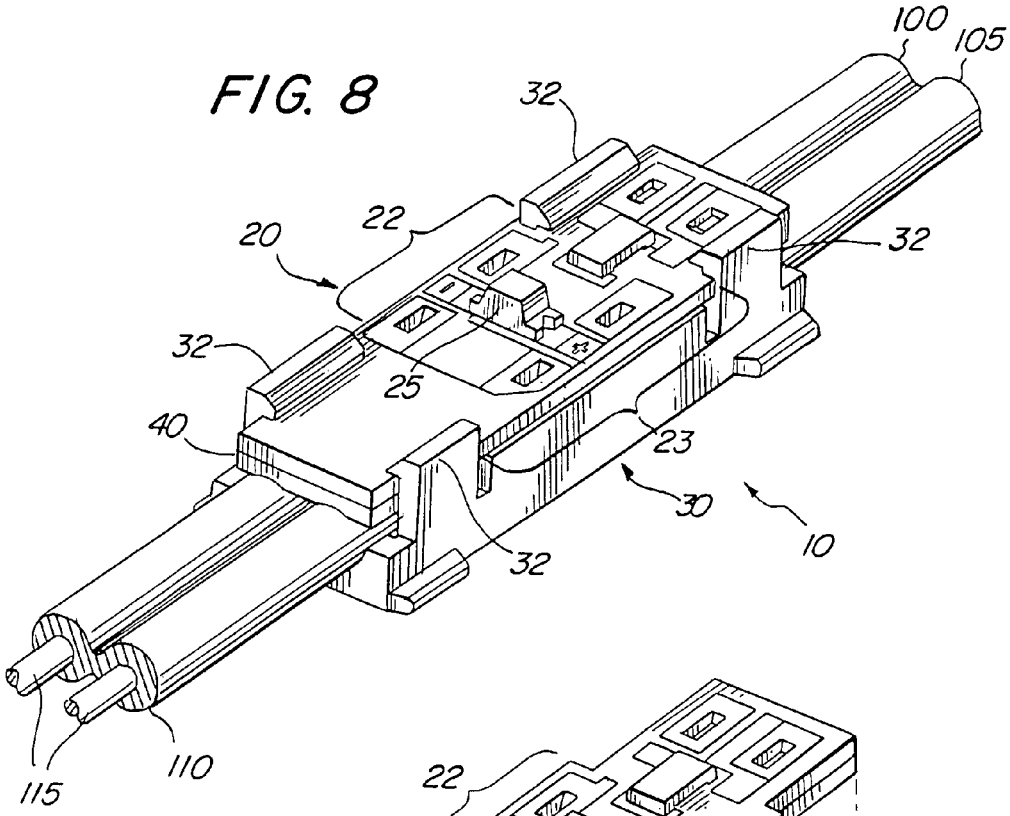
FIG. 8 is a perspective view of a preferred embodiment of the invention installed on two electrical leads.

This LED module 10 is also described in a co-pending patent application (U.S. patent Ser. No. 10/798,752) that is incorporated herein by reference. Referring now to FIG. 8, a preferred embodiment of the LED module 10 is shown installed on two electrical leads 100 and 105. A preferred embodiment of the LED module 10 is a complete modular unit comprising a light source and base for attaching the module to a set of leads. As shown, the preferred embodiment of the invention 10 comprises a circuit board 20 with a light emitting diode ("LED") 25. The preferred embodiment of the circuit board 20 provides an LED connector for dome LEDs, surface mount LEDs, surface mount diodes, and "piranha-style" LEDs. The circuit board 20 is removably secured to a base 30 by a set of snap tabs 32. Preferably, the circuit board 20 comprises support lengths 22 and 23 of differing lengths that correspond to distances between snap tabs 32 on the base 30. By having support lengths 22 and 23 on the circuit board 20 and corresponding differing lengths between the snap tabs 32, a user can be guided to install the circuit board 20 on the base 30 with proper polarity.

Preferably, the base 30 is open-ended and contains at least one pair of electrical leads 100 and 105 passing through the ends of the base 30. Additional leads can be present as well. For example, the use of 3 pairs of leads can provide Red-Green-Blue (RGB) LED functionality. The circuit board 20 is held snugly with the electrical leads 100 and 105 by the set of snap tabs 32. Preferably, a protective gasket 40 creates an environmentally protective seal between the circuit board 20 and the electrical leads 100 and 105.

Figure 9:
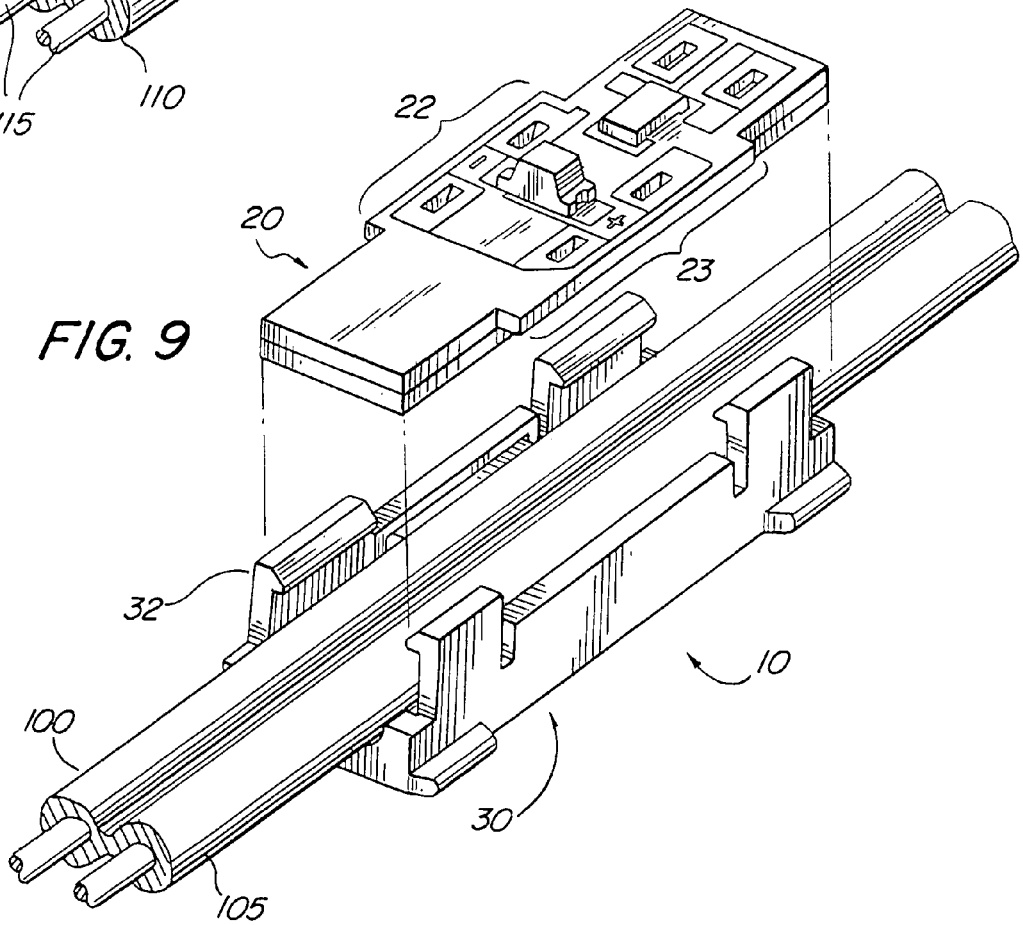
FIG. 9 is a partially exploded view of a preferred embodiment of the invention.

Referring now to FIG. 9, FIG. 9 shows the circuit board 20 and gasket 40 removed from the base 30 and leads 100, 105. Since the circuit board 20 and gasket 40 are preferably removable from the base 30, the LED 25 and/or the circuit board 20 becomes more easily replaceable when, inter alia, the LED burns out or is otherwise damaged. Furthermore, generally, when the circuit board 20 is removed from the base 30, the base 30 can be positioned or re-positioned along the electrical leads 100 and 105 if desired.

Figure 10:
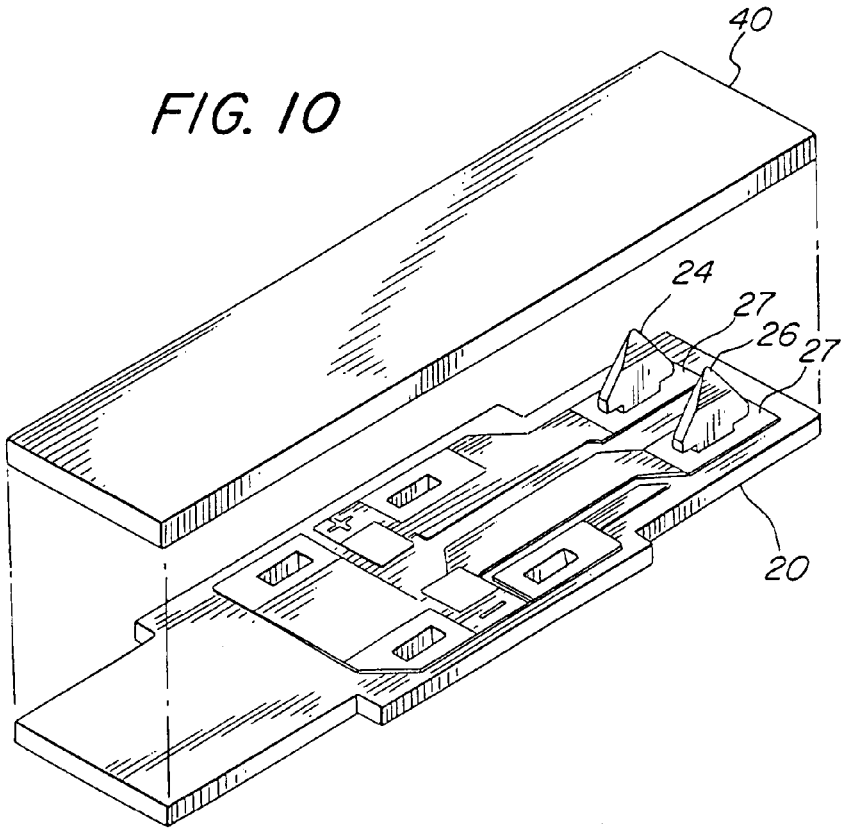
FIG. 10 is an exploded view of a preferred embodiment of a circuit board and a protective gasket for the invention; and, FIG. 11 is a preferred embodiment of a protective gasket installed on a circuit board for the invention.

FIG. 10 shows a bottom side of a preferred embodiment of the circuit board 20 and gasket 40. The circuit board 20 preferably has a set of at least two contact teeth 24, 26 connected to the LED on the circuit board 20. The contact teeth 24, 26 are preferably an electrically conductive material such as copper with tin plating. Alternatively, the teeth can comprise, inter alia, gold, silver, platinum and other conductive material. The teeth 24, 26 are preferably supported and held vertical on the circuit board 20 during production by a jig.

Figure 11:
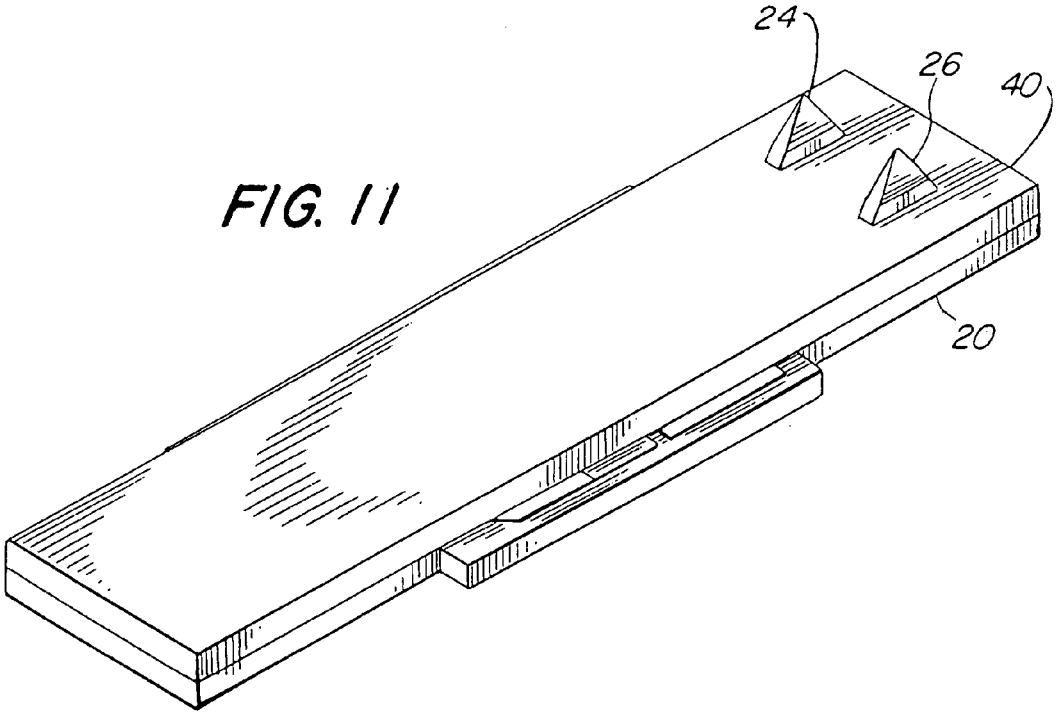

The contact teeth 24, 26 are preferably sharp enough to pierce the gasket 40. The preferred gasket material is vinyl foam tape with acrylic adhesive. Thus, the gasket 40 forms a protective barrier on the circuit board 20 while the contact teeth 24, 26 provide a conductive pathway to the circuit board 20 and the LED 25. A preferred embodiment of the gasket 40 installed on the circuit board 20 is shown in FIG. 11. As shown in FIG. 11, the conductive teeth 24, 26 are visible after traversing the thickness of the gasket 40. The gasket 40 is preferably affixed to the circuit board 20 by pressure sensitive double-sided adhesive.

Alternately, the gasket 40 can have pre-cut openings to allow the teeth 24, 26 to pass through the gasket 40 to allow electrical contact between the circuit board 20 and electrical leads. However, the gasket 40 should be sufficiently snug to the teeth 24, 26 to continue to provide protection for the circuit board 20.

Returning to FIG. 8, the electrical leads 100 and 105 are usually stranded wires and typically have a non-conductive sheath 110 around electrically conductive wire 115. The contact teeth 24, 26 of the circuit board 20 preferably pierce the non-conductive sheath 110 to make electrical contact with the conductive wire 115. During insertion into the sheath 110, shoulder mounts 27 on the circuit board 20 support the teeth 24, 26. The preferred embodiments of the contact teeth 24, 26 are coated in wax that is removed when the teeth 24, 26 are inserted into the non-conductive sheath 110. Each contact tooth preferably makes electrical contact with an opposing electrical lead (e.g. 26 to 100 or 24 to 105). Additionally, the non-conductive sheath 110 will often grab and hold the teeth 24, 26 in place and in contact with the leads. Thus, power is supplied to the circuit board 20 from the electrical leads 100 and 105 via the contact teeth 24, 26 while the non-conductive sheath 110 and gasket 40 continue to provide protection from the installed environment to the electrical components of the invention. Preferably and additionally, the circuit board is coated in a protective sealant to provide additional protection from the installed environment. The preferred sealant is acrylic conformal coating.

Thus, an improved replaceable LED module is described above that is capable of easy installation and replacement while offering improved environmental resistance. In each of the above embodiments, the different positions and structures of the LED module are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention.

For example, the circuit board 20, except for the contact teeth 24, 26, can be coated in a protective sealant and held snugly to the non-conductive sheath of the electrical leads 100 and 105, thereby omitting the gasket 40. Another alternate embodiment comprises a plastic circuit board with built-in circuit leads and LED(s) that then snaps onto the base. Therefore, it is to be understood that, within the scope of the appended claims, the invention may be practiced other than as specifically described herein.

What is claimed is:

1. A flexible surface lighting system comprising:

a base having a first hardness and a channel having opposing sides and a mount surface;

a first flange and a second flange having a second hardness less than the first hardness, attached to opposing sides of the channel on the base; and, a lens inserted into the channel and between the first and second flanges.

2. The flexible surface lighting system of claim 1 further comprising a lens buffer attached to the mount surface and supporting the lens.

3. The flexible surface lighting system of claim 2 where the lens buffer comprises a third hardness less than the first hardness.

4. The flexible surface lighting system of claim 1 where the first hardness is at least 94 Duro on the Shore OO scale.

5. The flexible surface lighting system of claim 4 where the second hardness is less than the first hardness.

6. A flexible surface lighting system comprising:

a base extrusion of polyvinyl chloride having a first hardness and a channel having opposing sides and a mount surface;

a first flange extrusion and a second flange extrusion of polyvinyl chloride having a second hardness less than the first hardness, attached to opposing sides of the channel on the base extrusion; and, a lens inserted into the channel and between the first and second flange extrusions.

7. The flexible surface lighting system of claim 6 further comprising a butt seal inserted in the channel.

8. The flexible surface lighting system of claim 6 where the base extrusion, first flange extrusion and second flange extrusion are co-extruded.

9. The flexible surface lighting system of claim 6 where the first hardness is from 89–98 Duro on the Shore OO scale.

10. The flexible surface lighting system of claim 9 where the second hardness is less than the first hardness.

11. A flexible surface lighting system comprising:

a base extrusion having a first hardness and a channel having opposing sides and a mount surface;

at least two electrical leads in the channel;

a first flange extrusion and a second flange extrusion of polyvinyl chloride having a second hardness less than the first hardness, attached to opposing sides of the channel on the base extrusion;

a lens inserted into the channel over the at least two leads and between the first and second flange extrusions; and, an LED module comprising a circuit board secured to a module base; where the LED module is attached to the at least two electrical leads in the channel below the lens; the circuit board having an LED and at least two contact teeth whereby each contact tooth makes electrical contact with one of the at least two electrical leads.

12. The flexible surface lighting system of claim 11 where the at least two electrical leads further comprise a non-conductive sheath and where each contact tooth pierces the non-conductive sheath to make electrical contact with one of the at least two electrical leads.

13. The flexible surface lighting system of claim 11 where a gasket with a thickness covers a side of the circuit board and where the at least two contact teeth traverse the thickness of the gasket to make electrical contact with the at least two electrical leads.

14. The flexible surface lighting system of claim 11 where the module base further comprises a set of snap tabs whereby the circuit board is secured to the module base by snapping the circuit board onto the base by the set of snap tabs.

15. The flexible surface lighting system of claim 14 where the circuit board further comprises a first support length and a second support length; where the first support length differs in length from the second support length; and where the set of snap tabs further comprise a first set of snap tabs separated by a first distance corresponding to the first support length and a second set of snap tabs separated by a second distance corresponding to the second support length whereby installation of the circuit board with a proper polarity on the module base is guided by the set of snap tabs and the first and second support length.

* * * * *